US006653541B1

(12) United States Patent
Minker

(10) Patent No.: US 6,653,541 B1
(45) Date of Patent: Nov. 25, 2003

(54) HIGH IMPACT DRUMSTICK

(76) Inventor: Gary A. Minker, 9000 Burma Rd., Palm Beach Gardens, FL (US) 33403

( * ) Notice: Subject to any disclaimer, the term of this patent is extended or adjusted under 35 U.S.C. 154(b) by 0 days.

(21) Appl. No.: 10/419,515

(22) Filed: Apr. 21, 2003

(51) Int. Cl.[7] ..... G10D 13/02
(52) U.S. Cl. ..... 84/422.4
(58) Field of Search ..... 84/422.4, 453

(56) References Cited

U.S. PATENT DOCUMENTS

| | | | | | |
|---|---|---|---|---|---|
| 3,174,660 | A | | 3/1965 | Bundy | |
| 4,106,079 | A | * | 8/1978 | Drury | 362/34 |
| 4,202,241 | A | * | 5/1980 | Lucas | 84/422.4 |
| 4,551,363 | A | | 11/1985 | Fenech | |
| 4,763,557 | A | * | 8/1988 | Donohoe | 84/422.4 |
| 5,044,250 | A | | 9/1991 | Beyer | |
| 5,341,716 | A | * | 8/1994 | Donohoe | 84/422.4 |
| 6,310,278 | B1 | * | 10/2001 | Butler | 84/422.4 |

OTHER PUBLICATIONS www.active musican.com.*
www.sticksgrip.com.*

* cited by examiner

*Primary Examiner*—Kimberly Lockett
(74) *Attorney, Agent, or Firm*—Malin, Haley & DiMaggio, P.A.

(57) ABSTRACT

A drumstick capable of varying the physical characteristics of an impact of the drumstick to a surface thereby varying the sound that the drumstick can produce when playing percussive type impact musical products is disclosed. The drumstick includes an outer, hollow rigid tube-like body member including a handle portion adapted to be held by the hand of a user. A pliable tube-like membrane structure is positioned within the outer hollow body member, the pliable structure changing its shape during use of the drumstick. A liquid medium is located within the pliable structure, the pliable structure being shaped to restrict the liquid to the handle portion of the drumstick, and as a rotational force/motion is applied by a user to the drumstick, the liquid is forced outwardly toward a striking area of the drumstick thereby resulting in a change of balance of the drumstick.

9 Claims, 1 Drawing Sheet

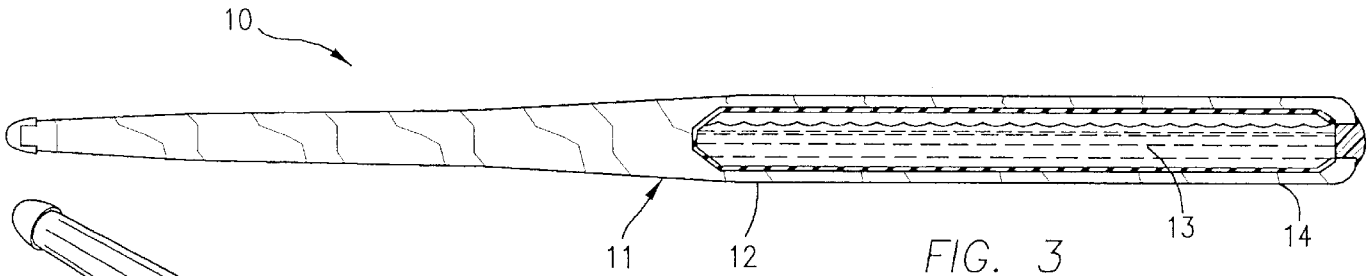
FIG. 3
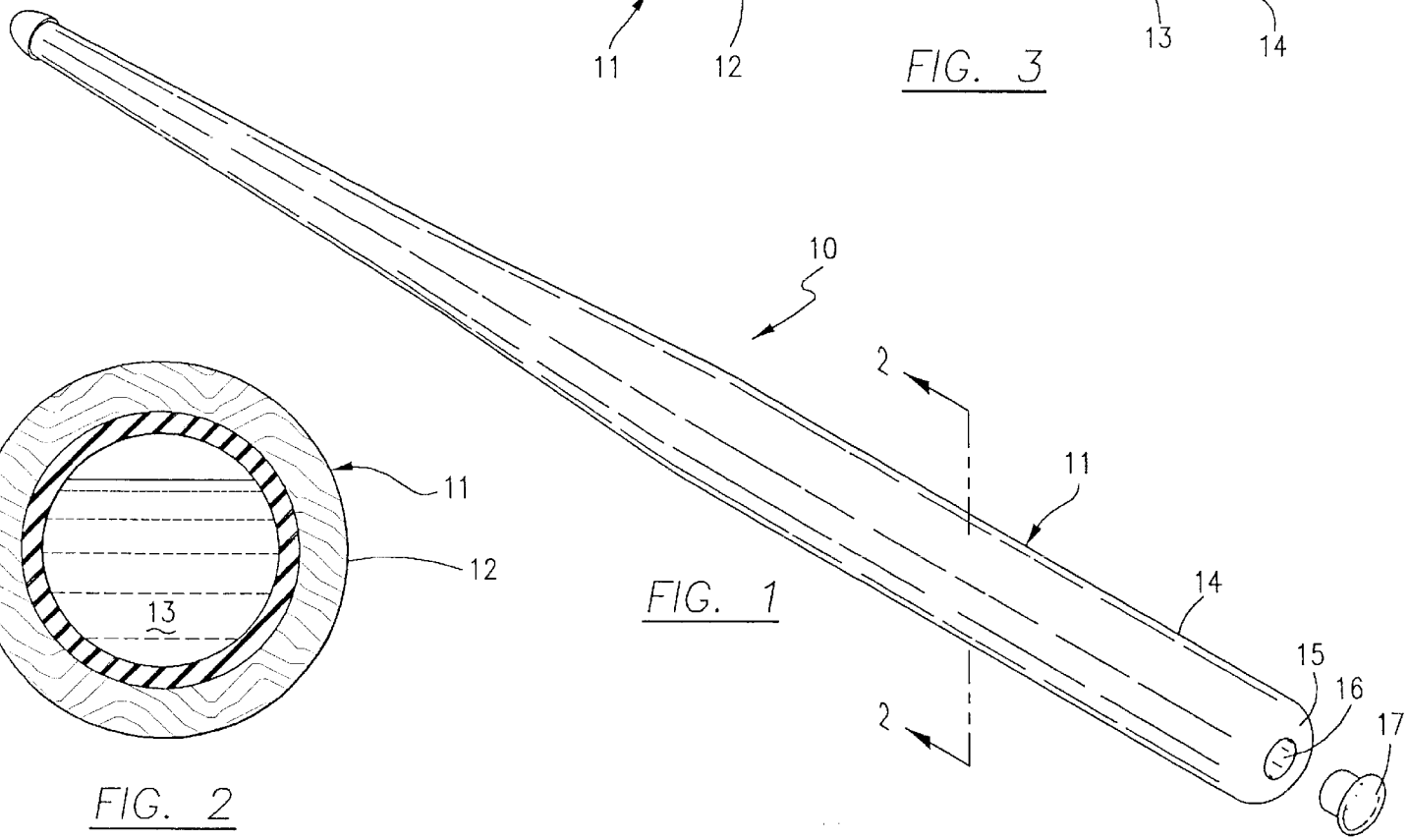
FIG. 1
FIG. 2

HIGH IMPACT DRUMSTICK

BACKGROUND OF THE INVENTION

1. Field of the Invention

The present invention relates to a striker that is used in creating rhythmic notes, and more particularly, to a striker in the form of a drumstick having a built in weight and balance feature capable of changing the impact/force ratios of the drumstick when the drumstick is manipulated and strikes a surface based upon its speed, momentum, centripetal force, and fluid dynamics, i.e. the drumstick's mass distribution change and mass balance distribution.

2. Description of Prior Developments

In the musical industry there have been many developments and improvements made in the field of drumsticks and the like. One motive for these developments has been for producing an effective and unusual visual effect. See for example, U.S. Pat. No. 4,202,241 which describes a drumstick that can be colored to fit the needs of an individual or a specific concert use. Also, see U.S. Pat. No. 4,551,363 which describes a drumstick with liquid mercury therein which causes an effect of flashes of light, and U.S. Pat. No. 4,106,079 which describes a system for selectively illuminating a drumstick so as to produce a stunning effect during a musical performance. Another motive for improving drumsticks has been specifically for the reason of imparting to the drumstick the ability to produce unusual or different sounds from a drum or other percussion instrument (See, for example, U.S. Pat. No. 6,310,278 B), or produce sound from the drumstick itself (See for example, U.S. Pat. No. 5,044,250). There have also been attempts to try to improve controlling the weight, balance and acoustical properties of drumsticks such as that which is described in U.S. Pat. No. 3,174,660. However, while the prior art. describes various types of devices which fulfill their respective and particular objectives and requirements, the aforementioned patents do not disclose or even remotely suggest a unique physical structure for a drumstick that has a major influence on the impact energy of the drumstick, and is not, just for the purpose of manufacturing an attractive appearing drumstick. In accordance with the features of the present invention, and in view partly of the way the drumsticks according to the present invention are used, there is described, a concept for a change in the weight balance of the drumstick, and a change in the drumstick's kinetic energy. This results in a higher tip mass for the drumstick, and therefore a greater overall impact to the drum.

Additional advantages of the invention will be set forth in part in the description which follows, and some advantages will be obvious from the description, or may be learned by practice of the invention in accordance with various features and combinations as particularly pointed out in the appended claims.

SUMMARY OF THE INVENTION

The improved features for drumsticks with regard to their physical characteristics, and the resulting advantages thereof, are obtained in accordance with the features of the present invention by employing a striker used manually in creating rhythmic notes and adopted to change the physical characteristics of its acoustics during use by the user. The striker which achieves this result comprises an outer hollow tube-like body member including a handle portion. The striker also includes a pliable tube-like structure positioned within the outer hollow body member, the pliable structure changing its shape during use of the striker, and a liquid medium located within the pliable structure. The pliable structure, is shaped to restrict the liquid to the handle portion of the striker, and as a rotational force/motion is-applied by a user to the striker, the liquid is forced via centrifugal force outwardly toward a striking area of the striker thereby resulting in a change of balance of the striker.

Another embodiment of the present invention illustrates a particular striker in the form of a drumstick capable of varying the physical characteristics of an impact of the drumstick to a surface thereby varying the sound that the drumstick can produce when playing percussive type impact musical products. The drumstick which exhibits these features includes an outer hollow tube-like body member including a handle portion that is held by the hand of the user. A pliable tube-like structure is positioned within the outer hollow body member, the pliable structure changing its shape during use of the drumstick. A liquid medium is located within the pliable structure. The pliable structure is shaped to restrict the liquid to the handle portion of the drumstick, and as a rotational force/motion is applied by a user to the drumstick, the liquid is forced via centrifugal force outwardly toward a striking area of the drumstick thereby resulting in a change of balance of the drumstick.

BRIEF DESCRIPTION OF THE DRAWINGS

FIG. 1 shows a perspective view of the present invention with the end cap in an exploded position.

FIG. 2 shows a side elevational view and cross section along line 2—2 of the present invention as shown in FIG. 1.

FIG. 3 shows a side elevational view partially cut away and cross section.

The accompanying drawing(s) which are incorporated and constitute a part of the specification illustrate one embodiment of the invention, and together with the following detailed description, serve to explain the principles of the present invention.

DESCRIPTION OF THE PREFERRED EMBODIMENT

While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention as defined by the appended claims.

FIGS. 1 through 3 depict an embodiment of a drumstick in accordance with the features of the present invention. There as illustrated in the FIGS. 1–3, a drumstick 10 is shown formed of outer hollow tube-like body member 11 which is formed of a rigid material such as, for example, a rigid, wooden or plastic material, and fashioned in the configuration of a drumstick as is typically used in the music business. Tube 11 is filled with a membrane-like pliable tube 12 that is molded in such a way so as to allow for a liquid material 13 to be contained within the pliable tube, and also allow the liquid material to move and cause the pliable tube to change its shape as it is positioned within outer rigid tube 11. The movement of the liquid material 13 that is contained within pliable tube 12 is caused by a force that is exerted by the hand of a user who is holding drumstick 10 by its handle portion 14. Handle portion 14 preferably includes an outer surface that is formed of a material that provides a firm griping surface for the hand of a user, the surface having non-slip properties. The use of the drumstick in accordance with the features of the present invention, will impart to the drumstick the ability to exhibit musical results in a wide range of musical related impactual scenarios. The drumstick further includes at its end portion 15 an opening 16 that permits one to insert a pliable tube 12 therein with its liquid filler material. Cap member 17 can be positioned within opening 16 so as to form a closure of opening 16. This can be accomplished in various ways such as, for example, by providing a threaded connection or a force fit connection between cap member 17 and opening 16. The result will be securing cap member 16 tightly on the end portion of the drumstick 10 so as to secure the pliable tubular insert 12 within drumstick 10 and keep the liquid material within insert 12.

Pliable tube member 12 is constructed of a membrane-like material which will change its shape upon the movement of the liquid material contained therein. Pliable tube member 12 can be molded from various types of materials such as, for example, a plastic material such as neoprene. Depending upon the particular viscosity required to alter the shape of the pliable tube insert, the liquid material that is placed within pliable tube 12 can have a viscosity ranging from distilled water to that of a machine oil such as, for example, a sewing machine oil.

Drumstick 10 in accordance with the features of the present invention is very simple in design, but utilizes many special conventions in the construction and design of its over-all shape, weight, materials and physical or mechanical feel of the object in order to make it pleasing to the hand during use, while maximizing the physical effect that it has both esthetically and acoustically.

The internal membrane like pliable tube 12 is filled with a liquid 13 that can be of various viscosities. This high density, replaceable combination of tube and liquid, is interchangeable with replacement selections of varying structure so that a wide range of weights, and motion attributes can be achieved at selected random times to suit the player which will result in a wide range of impactual scenarios.

The internal membrane/tube 12 is shaped in such a way that it restricts or confines the internal liquid to the handle area 14 of the tube while slow or low force motion is applied to the stick. Upon rotational force or motion of the drumstick 10 in a specific manner as to act upon (i.e. apply force to) the liquid, the liquid is forced via centrifugal force outwardly toward the tip or striking area of the drumstick which results in a change of balance of the drumstick. This change of balance results in a substantial change in the impactual force. Upon cessation of the rotational force, the liquid is squeezed back in to the handle portion 14, and the drumstick is positioned for a supplemental impact sequence.

The instant invention has been shown and described herein in what is considered to be the most practical and preferred embodiment. It is recognized, however, that departures may be made there from within the scope of the invention and that obvious modifications will occur to a person skilled in the art.

What is claimed is:

1. A drumstick capable of varying the physical characteristics of an impact of the drumstick to a surface thereby varying the sound that the drumstick can produce when playing percussive type impact musical products comprising:

an outer hollow rigid tube-like body member including a handle portion adopted to be held by a hand of a user;

a pliable tube-like membrane structure positioned within the outer hollow body member, the pliable structure changing its shape during use of the drumstick; and a liquid medium located within the pliable structure, the pliable structure being shaped to restrict the liquid to the handle portion of the drumstick, and as a rotational force motion is applied by a user to the drumstick, the liquid is forced via centrifugal force outwardly toward a striking area of the drumstick thereby resulting in a change of balance of the drumstick.

2. A drumstick according to claim 1 wherein the viscosity of said liquid varies from distilled water to about sewing machine oil.

3. A drumstick according to claim 1 wherein said liquid is distilled water.

4. A drumstick according to claim 1 wherein said liquid is a machine oil.

5. A drumstick according to claim 1 wherein said rotational force is a slow or low force motion that is applied to said drumstick.

6. A drumstick according to claim 1 wherein said change of balance of said drumstick is due to a higher drumstick tip weight.

7. A drumstick according to claim 1 wherein said liquid is re-positioned in said handle due to the user not applying said rotational force thereby positioning said liquid for a supplemental impact sequence.

8. The drumstick according to claim 1 wherein said handle portion includes an outer surface formed of a material that provides a firm gripping surface for the hand of the user, the gripping surface having non-slip properties.

9. A striker used in creating rhythmic notes and adapted to change the physical characteristics of its acoustics during use by the user comprising:

an outer hollow rigid tube-like body member including a handle portion adopted to be held by the hand of a user;

a pliable tube-like structure positioned within the outer hollow body member, the pliable structure changing its shape during use of the striker; and a liquid medium located within the pliable structure, the pliable structure being shaped to restrict the liquid to the handle portion of the striker, and as a rotational force/motion is applied by a user to the striker, the liquid is forced via centrifugal forced outwardly toward a striking area of the striker thereby resulting in a change of balance of the striker.

* * * * *